United States Patent [19]

Richard

[11] 4,221,258

[45] Sep. 9, 1980

[54] CARROUSEL WITH A HORIZONTAL, FIXED CIRCUIT, COMPRISING SEVERAL SOLIDARY ARMS ON A ROTATING DRUM WITH A VERTICAL AXIS

[75] Inventor: Gerard Y. Richard, Precy sur Oise, France

[73] Assignee: Societe D'Applications de Procedes Industriels et Chimiques S.A.P.I.C., Asnieres, France

[21] Appl. No.: 779,078

[22] Filed: Mar. 18, 1977

[30] Foreign Application Priority Data

Mar. 22, 1976 [FR] France ..... 76 08264

[51] Int. Cl.[3] ..... B22C 17/10

[52] U.S. Cl. ..... 164/181; 164/326; 164/183; 164/224

[58] Field of Search ..... 164/18, 181, 183, 185, 164/186, 165, 166, 224, 325, 326, 375, 409; 425/574–576, 439; 74/63; 108/20–22, 139–140; 312/125, 135, 202, 252

[56] References Cited

U.S. PATENT DOCUMENTS

| | | | |
|---|---|---|---|
| 723,983 | 3/1903 | Brooke | 164/326 |
| 2,806,262 | 9/1957 | Davis | 164/166 |
| 2,869,193 | 1/1959 | Bührer | 164/181 |
| 3,955,614 | 5/1976 | Geiger | 164/207 |

FOREIGN PATENT DOCUMENTS

| | | | |
|---|---|---|---|
| 731256 | 5/1932 | France | 425/439 |

*Primary Examiner*—Robert D. Baldwin
*Assistant Examiner*—K. Y. Lin
*Attorney, Agent, or Firm*—Matthew C. Thompson

[57] ABSTRACT

Apparatus useful in foundry moulding or casting embodying a turret having a plurality of arms rotatably mounted on and extending radially from a hub or drum rotatable about a vertical axis. The arms comprise a base, an inclined intermediate portion and an end portion parallel with the base. A fixed rack is disposed horizontally on the turret frame and extends along the arc of a circle in part of the zone swept by the arms during rotation of the hub. Each of the arms carries a pinion, whose teeth mesh with the teeth of the rack to induce rotation of each arm by 180° to invert the mould or die carried on the end of the arm.

8 Claims, 5 Drawing Figures

CARROUSEL WITH A HORIZONTAL, FIXED CIRCUIT, COMPRISING SEVERAL SOLIDARY ARMS ON A ROTATING DRUM WITH A VERTICAL AXIS

The present invention relates to a turret of horizontal closed circuit, comprising several arms fixed to a drum rotating about a vertical axis, carried by a frame.

One of the spheres of application of this turret is that of foundry work, more particularly of moulding or casting.

There are already known turrets comprising several arms each presenting at their extremity a tray on which are disposed tools, such as frames or pattern plates. On these turrets, during the rotation of the central spindle, the trays move from one work station to the next according to a continuous or discontinuous rhythm. All the movements necessary are thus executed on a single machine from the first to the last work station.

However, in certain spheres of application and more particularly in the foundry art, it is essential, at the last work station, to disengage the tools from the tray for inverting them in order to empty the mould. Moreover, it is known that the pattern plates and the frames used are cumbersome objects and above all extremely heavy, thus impossible to be manipulated by one workman.

Because of this fact, it is necessary to provide at turrets of this type machines which serve to invert the tray for proceeding to moulding.

The present invention has as its object the remedying of such a disadvantage, and to this effect it provides a turret presenting internal means for ensuring inversion of the trays. Relative to apparatuses known to date, the turret of the invention thus presents the enormous advantage of combining, in a same material, the displacement of the trays from one work station to the next (classical turret) and the inversion of the trays at the end of working (inversion machine). It is evident that the material of the invention reduces considerably the costs of buying and of maintenance and that furthermore there exists a considerably reduced free volume, equally at the moment of construction as at the moment of utilisation.

The present invention thus has for its object the new industrial product comprising a turret having a horizontal closed circuit, comprising n arms fixed to a drum turning about a vertical axis, carried by a frame, characterised by the fact that it comprises a fixed rack disposed horizontally on the frame, substantially along an arc of a circle, perpendicular to a part at least of the surface swept by the arms during rotation of the drum and that each of its n arms carries a pinion of a substantially horizontal axis whose teeth, meshing with those of the rack, provoke a pivoting of the arm about its axis. Thus, during displacement of an arm above the rack, there is caused simultaneous pivoting of the arm about its axis; it is consequently sufficient, as a function of the characteristics of the teeth of the rack and of the complementary ones of the pinion of the arm, to calculate the length of the rack to ensure a first pivoting of the arm of a value of 180°. In its inverted position, the tray disposed at the end of the arm can have its mould emptied. Finally, by a fresh displacement of the arm along a same length of rack, one can progressively cause a new pivoting of the arm of 180° such that the arm will be placed again in its original position. In a preferred embodiment of the invention, each of the n arms of the turret presents two elbows defining along the arm three segments disposed in the same plane, namely a base having a substantially horizontal axis, carrying the pinion, an intermediate portion inclined to said base, and an end portion, substantially parallel to the base. This particular construction, according to which the base and the end portion of one arm are not disposed as extensions the one of the other, implies that at the moment of inversion of the arm by 180° the position of the end portion relative to the ground is changed. The turret of this latter type comprises consequently two work positions at different levels, a lower position which is used for filling the moulds and a higher position which is caused for emptying the moulds. It is evident that only the geometrica characteristics (length and inclination) of the intermediate portion are present in the calculation of the two positions of the end portion of the arm relative to the ground.

In another particularly advantageous embodiment in which the rack is disposed at right angles to a part only of the surface swept by the arm during displacement of said arm in a horizontal plane, the base of the arm comprises means for clamping in position of rest the said arm on the motor device, when the arm sweeps the surface not overlapping the rack. Thus, above the rack, the position of inclination of the arm is regularly guided by the teeth of the pinion meshing with those of the rack. Finally, over all the surface swept by the arm not overlapping the rack, the arm is clamped on the rotating drum, that is to say that it is not possible for it to rotate; a fresh progressive pivoting of the arm only being able to arise from the moment when the teeth of the pinion return into engagement with the rack.

In this embodiment the base of the arm is provided with a rotating plate cooperating with a ball type of clamping system capable of clamping the plate in rest position relative to the control motor device of the arm, when the arm of which it is solid sweeps the surface not overlapping the rack. At the end of the rack, the balls of the clamping system each penetrate in a corresponding recess of the rotating plate, and consequently prevent the latter from turning on its shaft. Furthermore, during rotation of the turret, when the teeth of the pinion of the arm again engage the rack, the balls are disengaged from their recesses and the rotating plate can again be free for rotation, leading to progressive rotation of the arm on which it is fixed.

In a first preferred embodiment, the tray placed on the end portion of each arm is provided with rams for clamping the workpieces. In this case, preferably the fluid controlling opening and closing of all the rams of the turret is distributed by way of a central conduit within the turning drum and movable with the latter, n secondary conduits on the one hand opening into the central conduit, and on the other hand being connected each with the rams placed on the end portion of the arm.

The intermediate portion of each arm makes an angle of about 135° with the base on the one hand and with the end portion on the other hand. The difference in height between the upper level and the lower level occupied by the end portion is thus particularly easy to calculate since it is of the order of twice the length of the intermediate portion projected on the horizontal.

In another particular embodiment of the invention, the end portion of each arm is always placed at a man's height when said arm is in a horizontal plane, the minimum height of the end portion being of the order of 0.7 meters when the arm is in normal position, the maximum height of the end section being of the order of 1.5 meters when the arm is in a position rotated by 180° due to meshing of the teeth of its pinion with the teeth of its rack. In all these cases, the operative working on the turret is placed in the best conditions which are necessary for installing the tools at the first station and for emptying the moulds at the last station.

Naturally, the turret can operate with a continuous motion or with a discontinuous motion at the wish of the user.

For better understanding the object of the present invention, there will now be described below, for the purpose of non-limiting and purely illustrative example, one embodiment with reference to the accompanying drawings on which:

Figure 1:
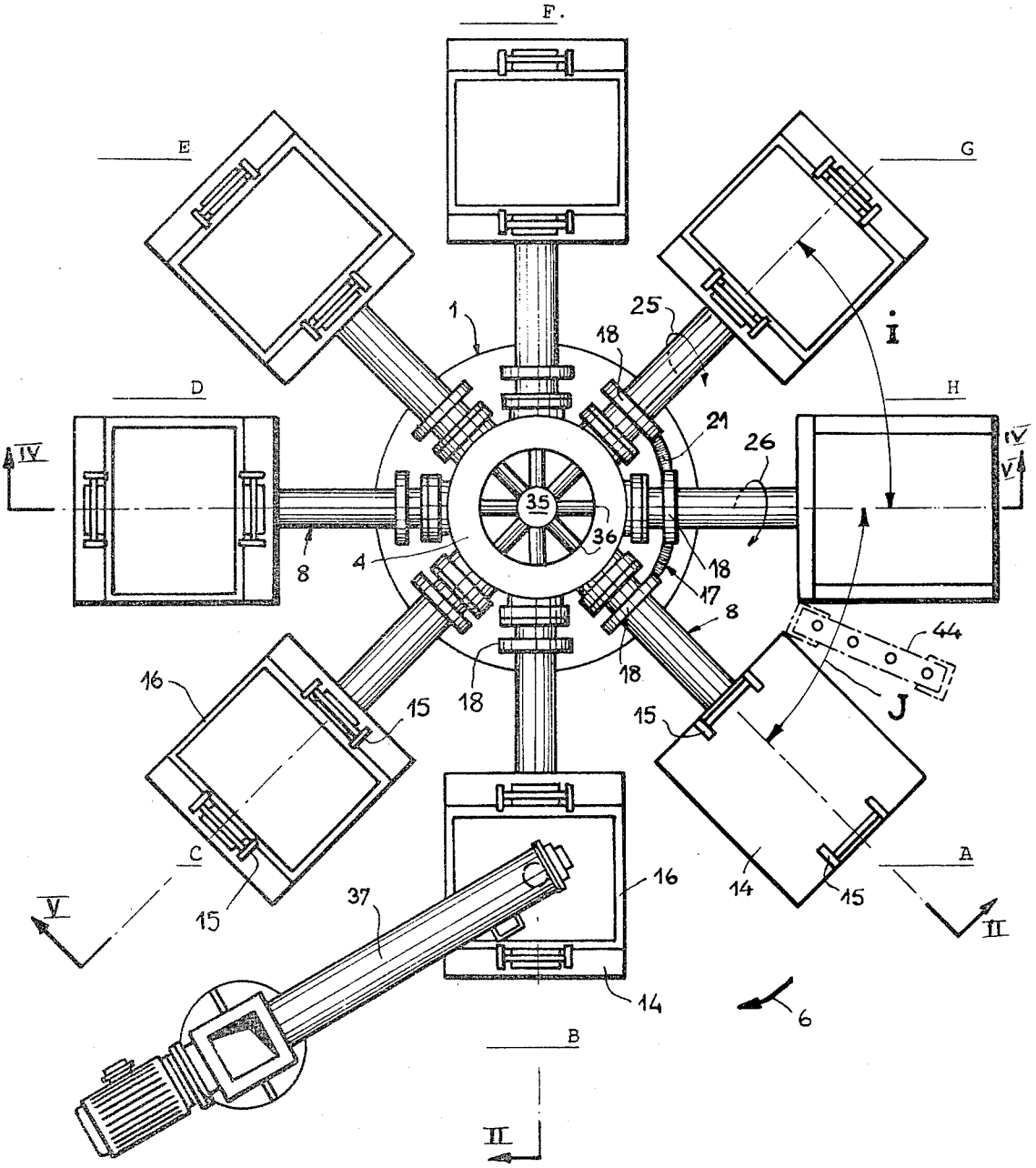
FIG. 1 shows an overhead view of the turret in accordance with the invention, comprising eight arms which constitute eight work stations.

Referring to the drawings, there can be seen designated by 1 a cylindrical frame anchored to the ground 3, for example around a trench in the form of a basin 2. The frame supports a rotating hub 4 of vertical axis 5 whose rotation, schematically illustrated by the arrow 6, following sequentially the position of the work stations, is controlled by a motor within the frame 1, concealed behind the access doors 7.

Arms 8, eight in number in the example illustrated, are disposed at regular intervals of 45° around the periphery of the rotating drum 4, on its vertical lateral wall. Each arm presents two elbows 9 and 10, respectively, defining along said arm three portions disposed in the same plane, that is to say a base 11 of substantially horizontal axis, an intermediate portion 12 inclined to said base, and an end portion 13 substantially parallel to the base 11. The end section of each arm is provided with a tray 14 comprising means such as hooks or catches 15 for mounting tools 16 such as pattern plates or frames.

A rack 17 is disposed and fixed horizontally on the upper face of the frame 1 along substantially an arc of a circle visible in FIG. 1. This rack 17 is placed at right angles to a part of the surface swept by the arms 8 and more precisely by the base portion 11 of these arms, during the rotation 6 of the drum 4. Furthermore, the base 11 of each arm carries a pinion 18 of substantially horizontal axis whose teeth 20 can mesh with the teeth 21 of the rack 17.

Each arm 8 is free for rotation about its horizontal axis coincident with the axis 19 of the pinion 18. To this purpose, a rotating plate 22 welded to the base 11 of the arm, is associated with the rollers 23 of a complementary plate 24 fixed to the turning drum 4. By virtue of the rollers 23, the plate 22 and consequently the base 11, that is to say all the arm 8, can rotate freely about the horizontal axis 19.

From the above, it will be noted that the pivoting of the arm can be provoked in each zone where it sweeps a portion of the rack 17. In fact, once one tooth 20 of the pinion 18 engages the first tooth 21 of the rack 17, the pinion 18 commences its rotation and drives with it the whole arm of which it is fixed, as is schematically illustrated by the arrow 25. The characteristics of construction of the teeth 20 and 21 determine by simple calculation the length of the rack 17 which provokes a rotation of precisely 180° of the arm which engages the rack. A length of the rack double the length just mentioned will of course provoke two successive revolutions of each arm as is shown by the arrows 25 and 26.

Finally, at the end of the rack, the pinion 18 is freed and the arm 8 is again idle on its axis 19. But besides, the position which the arm occupies at the instant when it leaves the rack, constituting a rest position of the arm must be preserved during the rest of the travel of the turret, it is necessary to clamp the arm in this rest position.

Furthermore, means ensuring clamping of the arm in rest position must be sufficiently adaptable for:

Guaranteeing clamping when the arm sweeps the surface not overlapping the rack;

Unclamping itself without risk of constraint when the teeth of the pinion carried by the arm engage the teeth of the rack.

Figure 3:
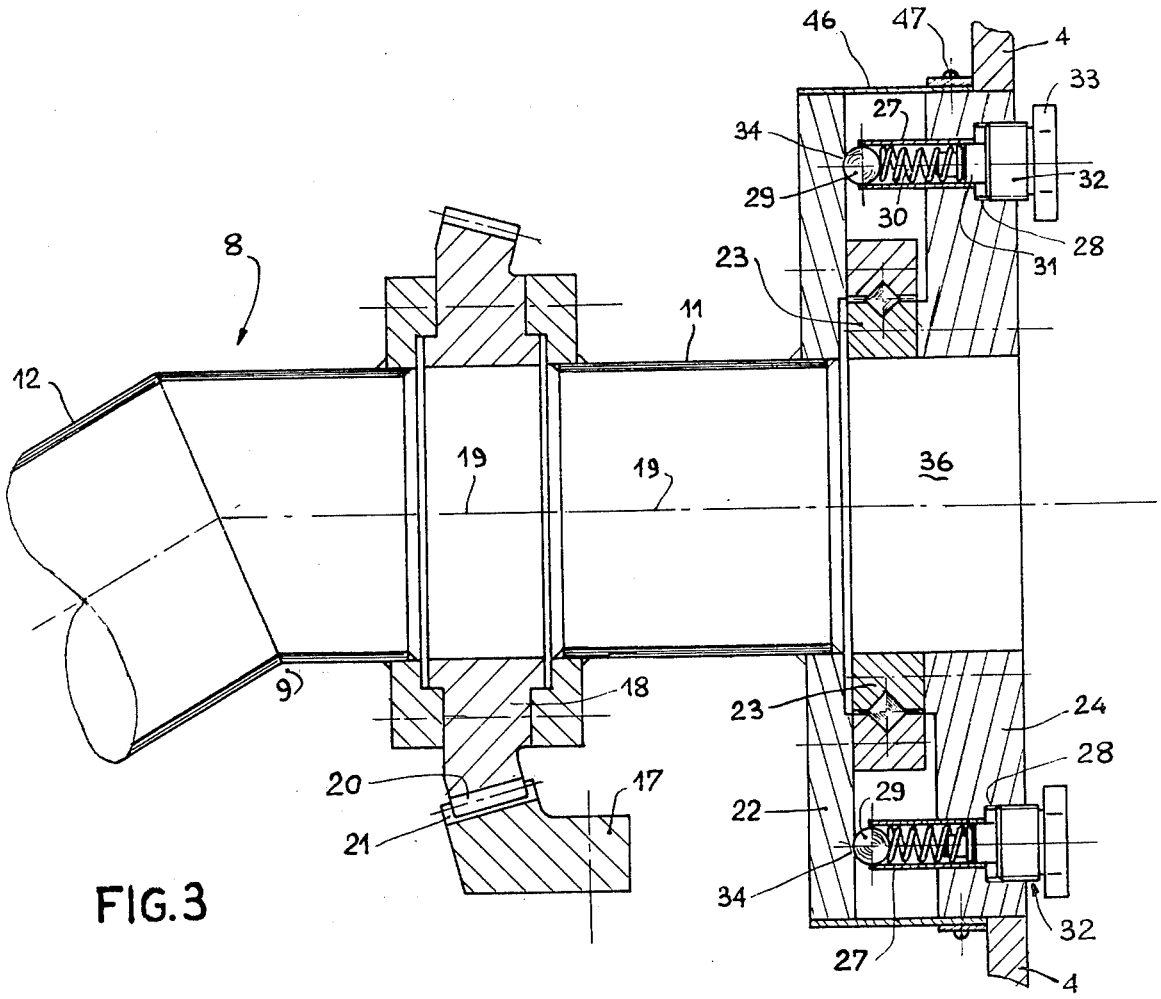
FIG. 3 shows a cross-sectional view of the connection of one arm of the rotating turret with the system for clamping the arm in rest position and of the system controlling pivoting by the rack.

With reference to FIG. 3 there is shown a clamping system corresponding exactly to the two exigencies mentioned above. The plate 24 fixed to the turning drum is pierced by two diametrically opposed orifices in each of which is placed a smooth tube 27. Each orifice, of greatest diameter at the side of the rotating drum is threaded at 28. Finally there are placed successively in the interior of the tube 27 a ball 29 and a spring 30 whose base is maintained by a guide 31 disposed at the end of a screw 32 having a head 33 and which cooperates with the threads 28. Two recesses 34, capable of each receiving a ball 29 are provided on the inside face of the plate 22. These two recesses are, of course, diametrically opposed. A sleeve 46 of rubber screwed at 47 protects the device as well as the rollers 23.

The operation of the clamping device described above is as follows:

At the end of the rack, when the pinion 18 leaves the last tooth 21 on the rack, the two recesses 34 are disposed in register with the balls 29 which consequently ensure clamping of the rotating plate 32. When the arm 8 sweeps the surface not overlapping the rack, the above-mentioned assembly remains clamped. Subsequently, when the pinion 18 again engages the rack, the torque exerted on the pinion and consequently on the plate 22 is sufficient to rotate the plate which frees itself from the weak impedance imposed by the ball 29 pushed by the springs 30. On a half-length of the rack, the plate 32 rotates through 180° and finds itself again in the preceding clamped position, that is to say that the balls 29 pushed by the springs penetrate again in the recesses 34 for assuring maintenance of the arm. In this clamped position, one can carry out operations at the end of the arm without risk of making it turn. A new movement of the pinion 18 on the rack provokes a new retreating movement of the springs 30 since the torque exerted on the plate 22 is greater than the feeble resistance of the springs. The recesses 34 being no longer placed against the balls 29, the plate 22 rotates again through 180° on the second half-length of the rack 17 before finding itself again in the original position shown in FIG. 3, in which the recesses 34 find themselves replaced opposite the balls 29 hence a new clamping of the arm is provoked by the balls, pressed into their recesses by the springs.

The fixing members 15 for tools 16 are advantageously provided with rams driving them for opening and closing. The operating fluid is then distributed along a central conduit 35 within the rotating drum and movable with the latter. Eight secondary conduits 36, opening in the central conduit, are furthermore connected each to the rams placed on the members 15 and being for example advantageously concealed in the interior of the bent arm 8 formed of three tubular sections.

The operation of the turret can be ensured continuously, or rather preferably discontinuously, with a short arrest time at each work station in order that the workman can carry out the necessary operations during the several seconds in which it is disposed at each stop in the stepwise rotation of the turret.

Figure 2:
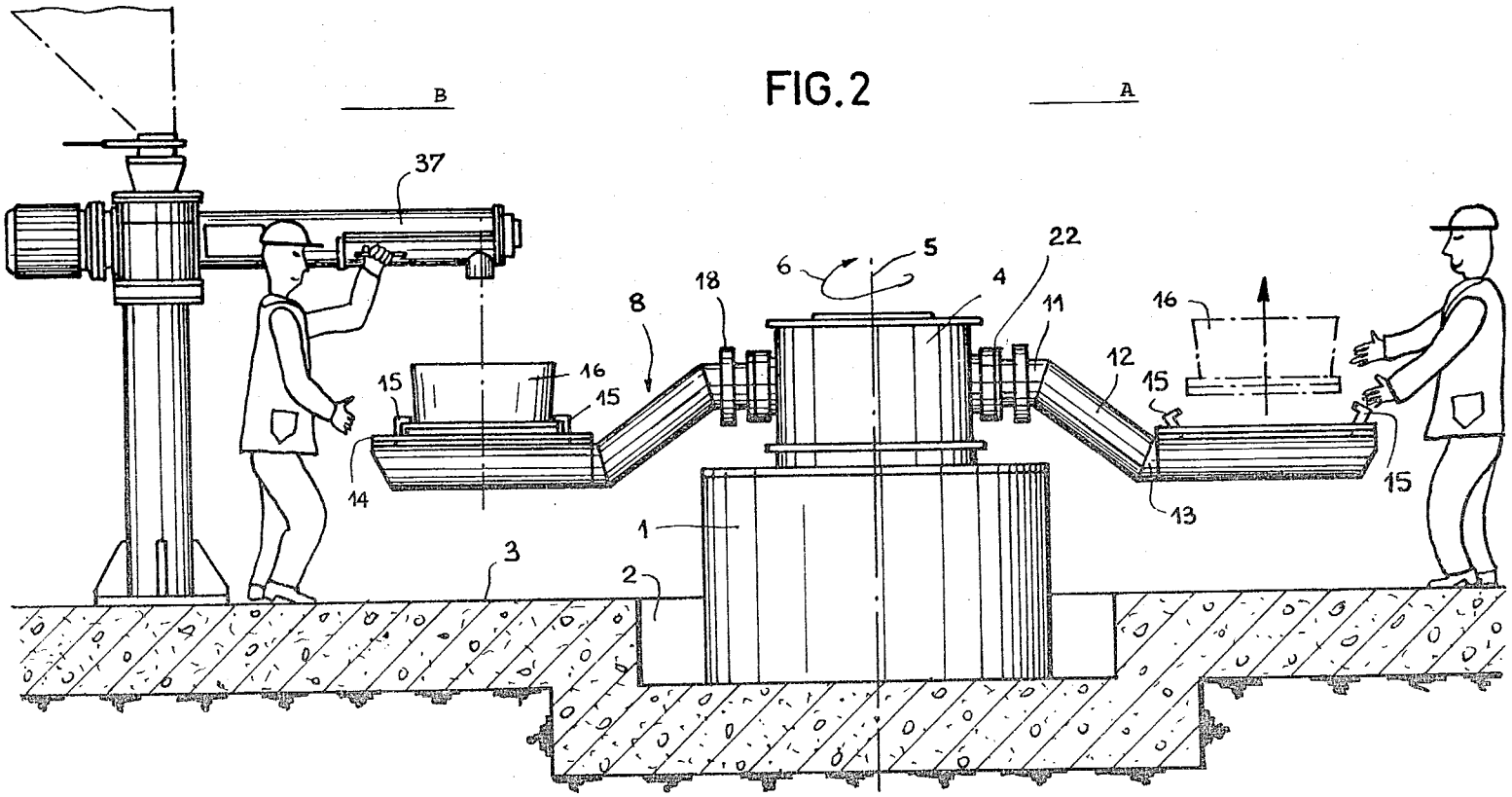
FIG. 2 shows a side view, along the line 2—2, of the turret of FIG. 1, the two illustrated work stations being: on the right the first station of the turret where there are carried out the changing or the cleaning of the tools and on the left, the second station of the turret where the moulds are filled.

At station A the operator proceeds to install pattern plates or frames, that is to say that he fixes the tools on the tray 14 with the aid of the devices 15 operated by the rams. Each tray 14 is provided with push buttons commanding opening and closing of the rams with which it is provided, it is thus not necessary to intervene at the general operating console. At station A the arm is just at the end of the rack 17, that is to say that it is in its rest position, clamped by the ball system. The turret turns then through one-eighth of a rotation and the tray, equipped as has been shown, comes into place opposite a mixer 37 provided at station B. At this station, the turret is stationary for several seconds in order that the moulds can be filled by the mixer with a granular composition comprising an inert charge and a binder for agglomerating the charge (FIG. 2).

Figure 5:
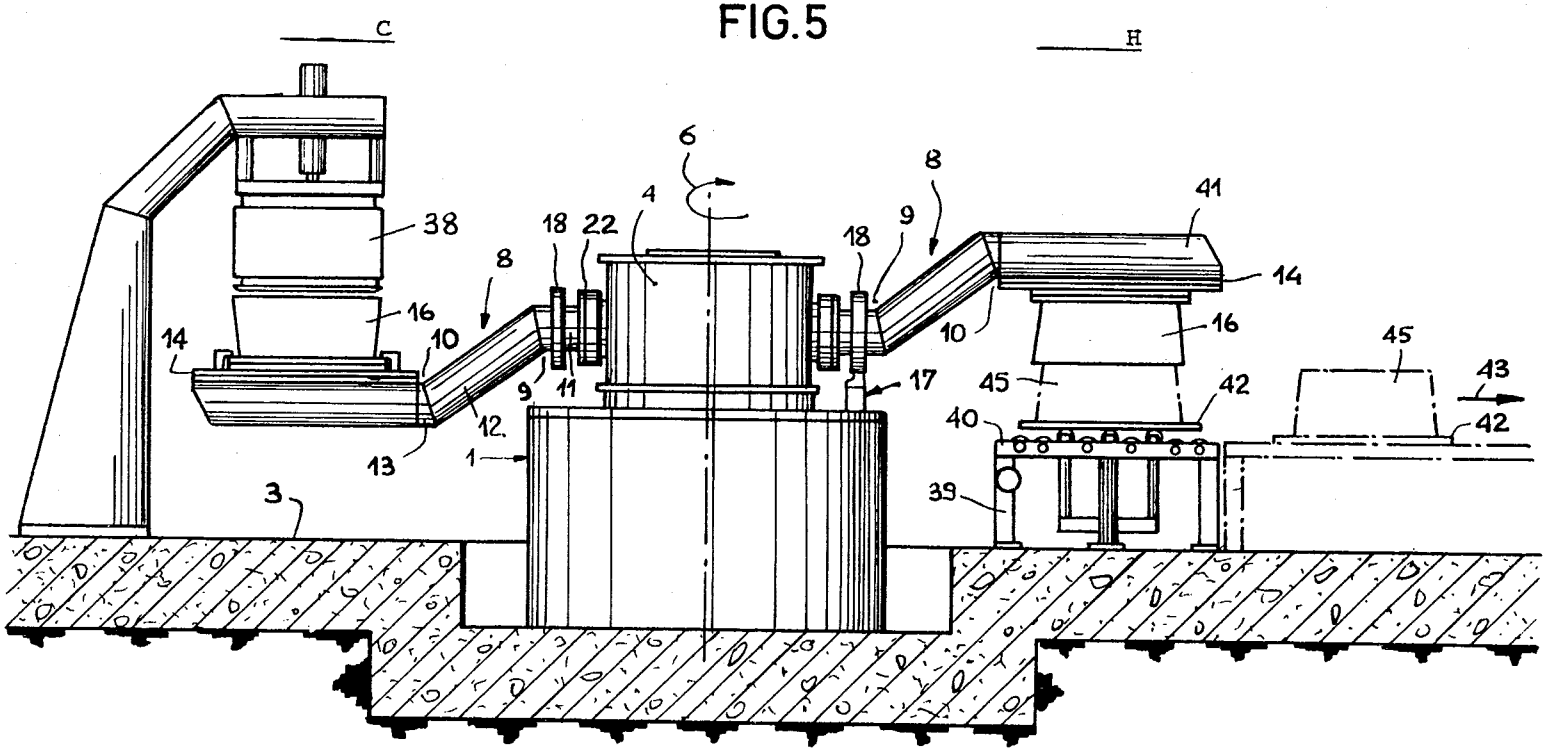
FIG. 5 shows a side view along the line V—V of the third and eighth work stations of the turret of the present invention.

Upon a new rotation of one-eighth of a revolution, the arm arrives at station C where binding of the above-mentioned composition is carried out with the aid of a compacter 38 (FIG. 5).

In the example shown on the accompanying drawings, the turret is free of all equipment at stations D, E, F, and G, the time of passing from station C to station G corresponding with the time necessary for the compositions to harden. Of course, if the mixture delivered at Station B by the mixer 37 is a self-hardening composition, the polymerising of the resin by a hardener will follow without it being necessary to add another reactant, and after binding at Station C, the setting of the mixture takes place on a half revolution of the turret. If on the contrary the mixture delivered at station B by the mixer 37 is not reactive, that is to say that it does not comprise a hardener of the resin, it is essential to introduce at one of the stations D, E, F, or G and preferably at station D, the hardener which can be in principle a gas such as an amine or carbonic acid, or sulphur dioxide for example.

Figure 4:
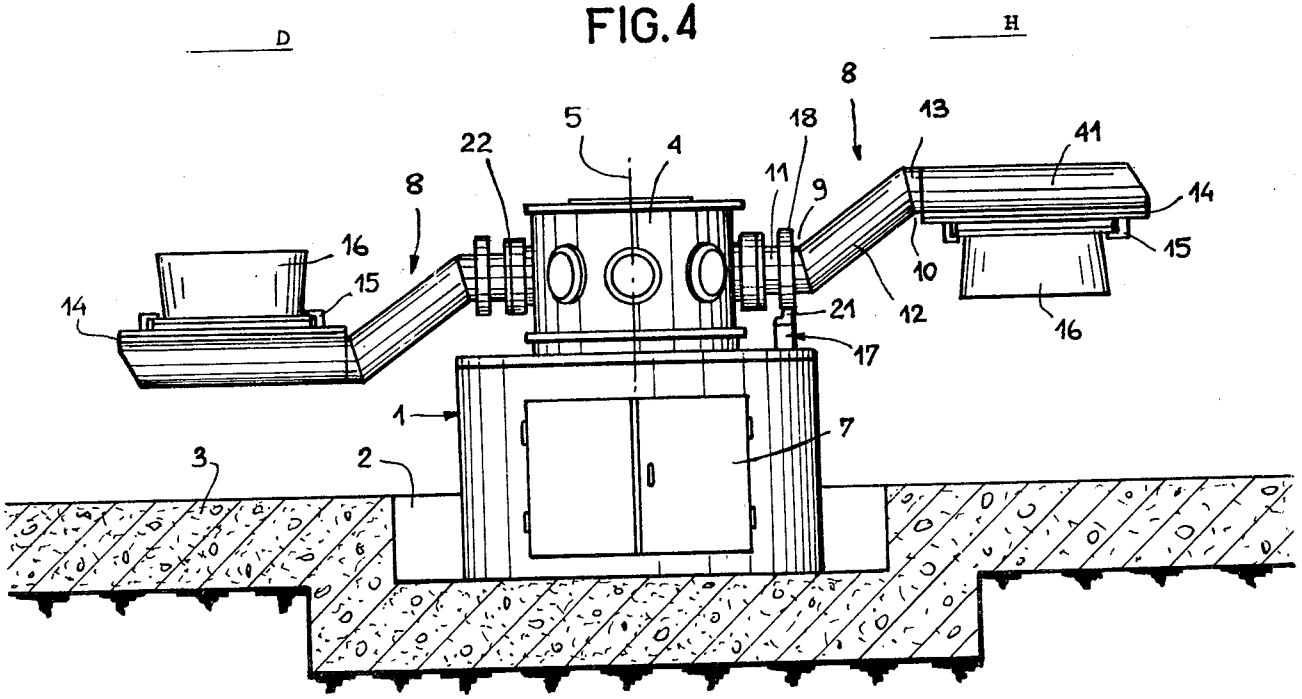
FIG. 4 shows a side view along the line IV—IV of the fourth and eighth work stations of the turret of the invention.

In arriving at station G, the pinion 18 fixed to the arm engages the first tooth 21 of the rack 17, this having the effect of simultaneously unclamping the ball device and of provoking pivoting of the arm as shown by the arrow 25. Between stations G and H, by the well-defined characteristic of the rack and of the pinion, the arm pivots through exactly 180° for finding itself again in the position shown in the right-hand part of FIG. 4. The turret stops again for several seconds in order to permit unloading of the pattern plates or of the frames. The station H is provided with a reception table 39 of which the working surface 40 is adjustable in height for coming as close as possible to the top of the inverted tool. One then operates a vibrator 41 which is provided at the end portion 13 of the arm. The shocks generated by the vibrator have the effect of making the hardened moulded articles fall onto a plate 42 which serves finally as a transport means, as shown by the arrow 43, on a belt or roller conveyor (FIG. 5).

After emptying the moulds, the turret turns once more through one-eighth of a revolution to convey the arms towards the starting station A. Between stations H and A the arm is once more inverted, as indicated by the arrow 26, through exactly 180°. During this latter displacement, the tools are incidentally cleaned by means of a nozzle 44 blowing compressed air. With return to station A the cleaning of the tools can be completed. It is equally possible to proceed to change them, that is to say, by opening followed by closing of the rams the workman installs a new tool (FIG. 2).

In the example illustrated and described, the rack 17 is constituted by an arc of a circle disposed on a quarter of a rotation of the turning devices. It is clear that this length is not absolutely limiting and that it is thus possible to conceive a turret along which the arms effect several complete rotations on their own, as an integral number or otherwise when several turns of the turret may be necessary in order to make each arm effect an exact number of rotations on its own. Equally, the rack has been chosen in the example mentioned above such that it leads to an inversion through 180° between the successive work stations disposed at 45° from one another. This construction is evidently not limitative, that is to say that an inversion of 180° can be obtained by another construction on a rack length separating two, three or four work stations.

It is to be noted finally, due to the fact of inclination of the intermediate portion 12 of the arm, that the base 11 and the end portion 13 are disposed at different levels when the arm is in its normal position (Stations A to G) or in its position inverted by 180° (station H). This construction has the advantage of allowing the worker to operate under the best conditions at each of the work stations. At stations A to G, the tools are in their lower position facilitating their installation, their changing, their cleaning, as well as charging the moulds and of binding the compositions distributed by the mixer, using a compacter.

By way of example, on a turret whose frame is of 1.6 meters in diameter, whose rotating drum is 0.9 meters in diameter, and whose total span, counted between the ends of the diametrically opposed trays, is 4.6 meters, one can place the axis 19 of the arms at one meter above the ground, the frame being varied by 0.4 meters. In this construction, an inclination of the intermediate portion of 135° with respect to the base and the end portion, places the tray 14 at 0.77 meters above the ground, this is a height permitting simple work by the operator charged with installing and loading the moulds. When the arm is at station H, inverted by 180°, the highest part of its end section is at 1.45 meters. Consequently, for a tool whose mean height is of the order of 30 cms, one can situate the latter at station H at a height of 0.8 meters above the ground which facilitates emptying the moulds of moulded articles 45 on a receiving table whose mean height is 0.5 meters.

The elbowed construction of the arm presents a considerable advantage at the level of station H. In fact, this construction permits considerable elevation of the top of the tools when the arm is inverted, and thus a simple unloading of the mould on a table of 50 cms high without it being necessary after inversion of the arm to use an elevating machine for leading the moulded articles emptied from the moulds to the transporting device.

The invention permits at one time the elimination of an associated machine for inverting the moulds. The elbowed construction of its arms thus permits the elimination equally of an associated elevating machine for the moulded articles. This construction is notably very advantageous in the case where the frames employed have a height of the order of 60 cms, this corresponds substantially to twice the standard height of 30 cms. In fact, one arm, non-cranked, placed on the turret such that its height of working will be satisfactory from Station A to Station G will result in, after inversion at station H placing the top of a tall frame at a height of about 20 cms from the ground. It was thus here necessary to use a secondary elevating machine for carrying the moulded article as far as the transporting device.

Naturally, the invention is not limited to the mode of application nor to the embodiment which has been mentioned. One can conceive of several different variations without departing from the scope of the present invention, notably as regards the number and the relative disposition of the zones of inversion of the arms which can be infinitely variable; the disposition adjacent the two inversion zones I and J assuring two successive inversion of 180° each not being absolutely limitative; and the inclination of the intermediate portion of the arm with respect to the base and with respect to the end section, which is not limited to 135° as in the example stated, but is greater than 0° and less than 180°.

It will thus be seen from the foregoing description and the illustrated embodiments that the invention provides a process for emptying foundry moulds or dies comprising the steps of inverting the mould and simultaneously raising said mould relative to a member onto which the moulded articles are to be discharged to a height such that the operative in charge of the mould-emptying operation works at a substantially constant height.

The invention further provides a moulding apparatus comprising means for moving a mould to mold emptying station, and means for causing at least two simultaneous displacements of a mould, said displacements comprising (a) inversion of the mould through 180°; and (b) elevation of the said mould, relative to a member onto which the moulded article is to be discharged to a height such that the operative in charge of the mould-emptying operation works at a substantially constant height.

What we claim is:

1. A turret useful in foundry work for moulding and casting, said turret having a horizontal closed circuit, and comprising a plurality of arms rotatably mounted on and extending laterally from a rotating drum having a vertical axis of rotation, said drum being rotatably carried by a frame wherein said turret embodies a fixed rack disposed horizontally on the frame substantially along an arc of a circle, perpendicular to a part at least of the surface swept by the arms during rotation of the drum, and that each of said arms carries a pinion with a substantially horizontal axis of rotation, the teeth of which, upon meshing with those of the rack, cause rotation of the arm about its axis of rotation, each of said arms having a base with a substantially horizontal axis of rotation rotatably mounted on and extending substantially horizontally from said drum, said base carrying said pinion, each of said arms further having an intermediate portion inclined relative to said base and an end portion substantially parallel to said base.

2. A turret according to claim 1, characterised by the fact that the end portion of each arm is provided with a tray on which are disposed tools such as for example frames or pattern plates.

3. A turret according to claim 1 in which the rack is disposed perpendicular to a part only of the surface swept by the arms during rotation of the drum, characterised by the fact that the base of each arm comprises means for clamping said arm in a rest position on the turning drum when the arm sweeps the surface not overlapping the rack.

4. A turret according to claim 3, characterised by the fact that each base of the arm is provided with a pivoting plate cooperating with a ball-type clamping system capable of clamping the plate in a rest position relative to the turning drum when the arm to which it is fixed sweeps the surface not overlapping the rack.

5. A turret according to claim 2, characterised by the fact that the tray placed on the end portion of each arm is provided with means for clamping the tools.

6. A turret according to claim 5 characterised by the fact that a fluid controlling opening and closing of all said means is distributed by way of a central conduit within the turning drum and movable with the latter, secondary conduits on the one hand opening into the central conduit and on the other hand being connected each with the means placed at the end portion of an arm.

7. A turret according to claim 1 characterised by the fact that the end portion of each arm is always placed at a height of a man when said arm is in a vertical plane, the minimum height of the end portion being of the order of 0.7 meters when the arm is in normal position, the maximum height of the end portion being of the order of 1.5 meters when the arm is in a position inverted by 180° by the meshing of the teeth of its pinion with the teeth of the rack.

8. A turret according to claim 1 wherein said intermediate portion forms an angle of 135° with each of said base and said end portion.

* * * * *